US012038213B2

(12) United States Patent
Koike et al.

(10) Patent No.: US 12,038,213 B2
(45) Date of Patent: Jul. 16, 2024

(54) REFRIGERATION CYCLE APPARATUS

(71) Applicant: Mitsubishi Electric Corporation, Tokyo (JP)

(72) Inventors: Takanori Koike, Tokyo (JP); Koji Azuma, Tokyo (JP); Naomichi Tamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 293 days.

(21) Appl. No.: 17/780,743

(22) PCT Filed: Feb. 3, 2020

(86) PCT No.: PCT/JP2020/003851
§ 371 (c)(1),
(2) Date: May 27, 2022

(87) PCT Pub. No.: WO2021/156901
PCT Pub. Date: Aug. 12, 2021

(65) Prior Publication Data
US 2022/0412622 A1 Dec. 29, 2022

(51) Int. Cl.
*F25B 49/02* (2006.01)
*F25B 13/00* (2006.01)
(Continued)

(52) U.S. Cl.
CPC ..... *F25B 49/02* (2013.01); *F25B 13/00* (2013.01); *F25B 40/06* (2013.01); *F25B 41/34* (2021.01);
(Continued)

(58) Field of Classification Search
CPC ..... F25B 49/02; F25B 13/00; F25B 40/06; F25B 41/34; F25B 2400/0401;
(Continued)

(56) References Cited

U.S. PATENT DOCUMENTS

2018/0328639 A1 11/2018 Koike et al.
2020/0064040 A1* 2/2020 Koike ..... F25B 49/022
(Continued)

FOREIGN PATENT DOCUMENTS

JP S61-133770 U 8/1986
JP H03-008921 Y2 3/1991
(Continued)

OTHER PUBLICATIONS

International Search Report of the International Search Authority mailed Mar. 31, 2020 in corresponding International Application No. PCT/JP2020/003851 (and English machine translation).
(Continued)

*Primary Examiner* — Marc E Norman
(74) *Attorney, Agent, or Firm* — Posz Law Group, PLC

(57) ABSTRACT

A refrigeration cycle apparatus includes: a refrigerant circuit in which a compressor, a heat-source-side heat exchanger, a first expansion device, a second expansion device, and a load-side heat exchanger are sequentially connected by refrigerant pipes and in which refrigerant is circulated; a controller that controls the refrigerant circuit; a bypass pipe extending from a liquid pipe between the first expansion device and the second expansion device toward a suction side of the compressor; a third expansion device provided at the bypass pipe to decompress the refrigerant that flows through the bypass pipe; and a refrigerant cooler provided at the bypass pipe and downstream of the third expansion device to cause heat exchange to be performed between the refrigerant decompressed by the third expansion device and heat generated from the controller.

3 Claims, 10 Drawing Sheets

(51) Int. Cl.
*F25B 40/06* (2006.01)
*F25B 41/34* (2021.01)

(52) U.S. Cl.
CPC ..... *F25B 2400/0401* (2013.01); *F25B 2400/0411* (2013.01); *F25B 2600/2501* (2013.01)

(58) Field of Classification Search
CPC ..... F25B 2400/04011; F25B 2400/13; F25B 2600/2501; F25B 2600/2509; F25B 2600/2513; F25B 2700/1931; F25B 2700/1933; F25B 2700/2113; F25B 2700/21151
See application file for complete search history.

(56) References Cited

U.S. PATENT DOCUMENTS

| | | | | |
|---|---|---|---|---|
| 2022/0011028 | A1* | 1/2022 | Koike | F25B 41/20 |
| 2023/0272952 | A1* | 8/2023 | Ishiyama | F25B 13/00 62/132 |

FOREIGN PATENT DOCUMENTS

| | | | |
|---|---|---|---|
| JP | 2018-096575 | A | 6/2018 |
| WO | 2017/130319 | A1 | 8/2017 |

OTHER PUBLICATIONS

Extended European Search Report dated Dec. 13, 2022 issued in corresponding EP Patent Application No. 20917465.5.

* cited by examiner

REFRIGERATION CYCLE APPARATUS

CROSS REFERENCE TO RELATED APPLICATION

This application is a U.S. national stage application of PCT/JP2020/003851 filed on Feb. 3, 2020, the contents of which are incorporated herein by reference.

TECHNICAL FIELD

The present disclosure relates to a refrigeration cycle apparatus including a cooling mechanism for a controller.

BACKGROUND ART

In the past, a refrigeration cycle apparatus including a cooling mechanism for a controller has been known. Patent Literature 1 discloses a refrigeration cycle apparatus in which after part of refrigerant is bypassed from a high-pressure side of a refrigerant circuit and is made to transfer heat in a precooling heat exchanger, the refrigerant is made to flow to a refrigerant cooler and is made to exchange heat with a controller, thereby cooling the controller. After cooling the controller in the refrigerant cooler, the part of refrigerant that has been bypassed from the high-pressure side of the refrigerant circuit passes through an expansion device for controlling the flow rate of the refrigerant in the refrigerant cooler and flows to a low-pressure side of the refrigerant circuit.

CITATION LIST

Patent Literature

Patent Literature 1: International Publication No. 2017 0319

SUMMARY OF INVENTION

Technical Problem

The refrigeration cycle apparatus disclosed in Patent Literature 1, however, bypasses refrigerant from a high-pressure side between a discharge side of a compressor and a heat-source-side heat exchanger or a load-side heat exchanger, and returns the refrigerant to a low-pressure side. Therefore, the flow rate of refrigerant that flows in the heat-source-side heat exchanger or the load-side heat exchanger is reduced by the amount of the bypassed refrigerant. Accordingly, the heating and cooling capacity of the refrigeration cycle apparatus may be decreased.

The present disclosure is applied to solve the above problem, and relates to a refrigeration cycle apparatus that reduces a decrease in its heating and cooling capacity.

Solution to Problem

A refrigeration cycle apparatus according to the present disclosure includes: a refrigerant circuit in which a compressor, a heat-source-side heat exchanger, a first expansion device, a second expansion device, and a load-side heat exchanger are sequentially connected by refrigerant pipes and in which refrigerant is circulated; a controller configured to control the refrigerant circuit; a bypass pipe extending from a liquid pipe between the first expansion device and the second expansion device toward a suction side of the compressor; a third expansion device provided at the bypass pipe, and configured to decompress the refrigerant that flows through the bypass pipe; and a refrigerant cooler provided at the bypass pipe and downstream of the third expansion device, and configured to cause heat exchange to be performed between the refrigerant decompressed by the third expansion device and heat generated from the controller.

Advantageous Effects of Invention

According to the present disclosure, the bypass pipe, at which the refrigerant cooler configured to cool the controller is provided, extends from the liquid pipe between the first expansion device and the second expansion device toward the suction side of the compressor. Therefore, the refrigerant discharged from the compressor flows to the heat-source-side heat exchanger or the load-side heat exchanger without being bypassed. It is therefore possible to avoid a loss in the capacity that would occurs if the refrigerant discharged from the compressor were bypassed. Accordingly, it is possible to reduce a decrease in the heating and cooling capacity.

DESCRIPTION OF EMBODIMENTS

An embodiment of a refrigeration cycle apparatus according to the present disclosure is described below with reference to the drawings. The present disclosure is not limited to the embodiment described below. The relationships in size between components in figures including FIG. 1 that will be referred to below may differ from those of actual ones. In the following descriptions, in order that the present disclosure be easily understood, terms related to directions are used as appropriate. However, the terms are used only for explanation of the present disclosure, but do not limit the present disclosure. As examples of the terms, "upper", "lower", "right", "left", "front", "rear", etc., are present.

Embodiment 1

Figure 1:
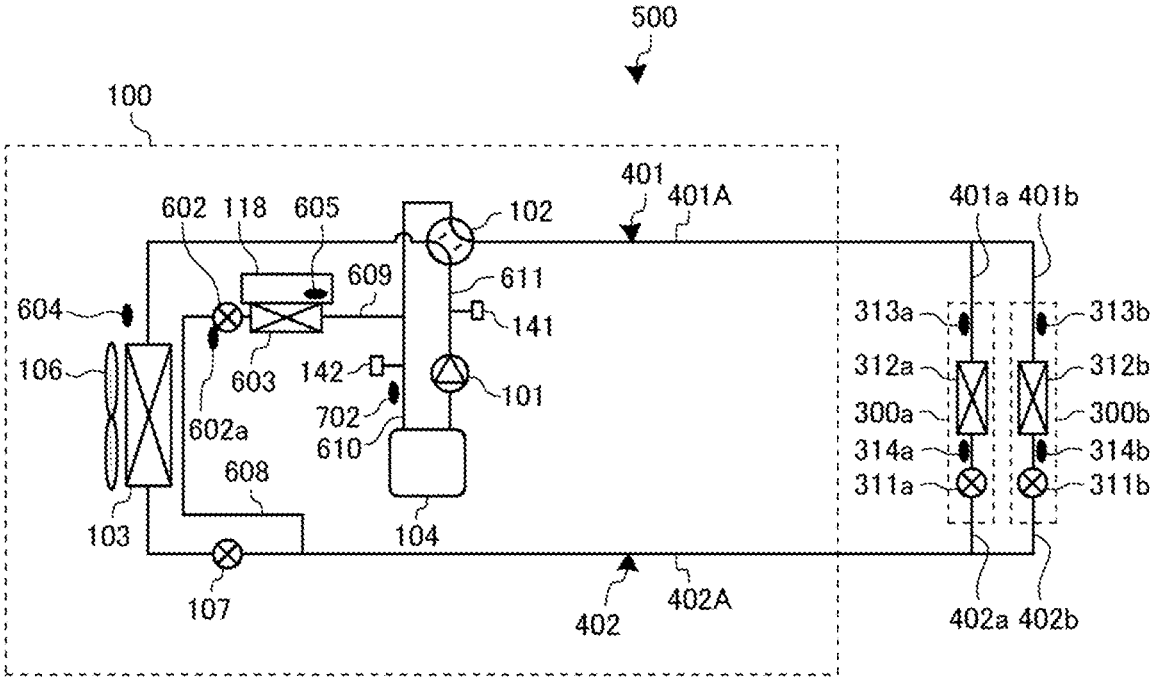
FIG. 1 is a circuit diagram illustrating a refrigeration cycle apparatus according to Embodiment 1.

FIG. 1 is a circuit diagram illustrating a refrigeration cycle apparatus according to Embodiment 1. Embodiment 1 will be described by referring to the case where a refrigeration cycle apparatus 500 is an air-conditioning apparatus. The refrigeration cycle apparatus 500 is installed, for example, in a building or a condominium, and performs a cooling operation or a heating operation with a heat pump cycle, which is a refrigeration cycle of a refrigeration cycle circuit in which refrigerant is circulated.

As illustrated in FIG. 1, the refrigeration cycle apparatus 500 includes a heat-source-side unit 100 and load-side units 300. In the refrigeration cycle apparatus 500, the heat-source-side unit 100 and each of the load-side units 300 are connected by a gas pipe 401 and a liquid pipe 402, whereby a refrigeration cycle circuit is formed. The gas pipe 401 includes a gas main pipe 401A and gas branch pipes 401*a* and 401*b*. The liquid pipe 402 includes a liquid main pipe 402A and liquid branch pipes 402*a* and 402*b*. Regarding Embodiment 1, it is illustrated by way example that two load-side units 300*a* and 300*b* are provided as load-side units 300. However, the number of load-side units 300 may be one, or may be three or more.

(Heat-Source-Side Unit 100)

The heat-source-side unit 100 has a function of supplying cooling energy or heating energy to the load-side unit 300.

The heat-source-side unit 100 includes a compressor 101, a flow switching device 102, a heat-source-side heat exchanger 103, a first expansion device 107, and an accumulator 104. These components are connected in series to form part of a main refrigerant circuit. The heat-source-side unit 100 is provided with a heat-source-side fan 106.

(Compressor 101)

The compressor 101 sucks low-temperature and low-pressure gas refrigerant, compresses the low-temperature and low-pressure gas refrigerant to change it into high-temperature and high-pressure gas refrigerant, discharges the high-temperature and high-pressure gas refrigerant, causes the refrigerant to circulate in the refrigerant circuit to perform an operation related to air-conditioning. The compressor 101 may be, for example, an inverter compressor whose capacity can be controlled. The compressor 101 is not limited to such an inverter compressor whose capacity can be controlled. For example, the compressor 101 may be a fixed-speed compressor or a compressor obtained by combining an inverter compressor and a fixed-speed compressor. Any type of compressor may be used as the compressor 101 as long as it can compress sucked refrigerant to change it into high-pressure refrigerant; that is, the compressor 101 is not limited to a specific type compressor. As the compressor 101, for example, one of the following various types of compressors may be used: a reciprocating compressor; rotary compressor; a scroll compressor; and a screw compressor.

(Flow Switching Device 102)

The flow switching device 102 is provided on a discharge side of the compressor 101, and switches a refrigerant flow passage between a refrigerant flow passage in the cooling operation and that in the heating operation. The flow switching device 102 controls the flow of the refrigerant depending on which of operation modes is set, such that the heat-source-side heat exchanger 103 operates as an evaporator or a condenser. In Embodiment 1, the flow switching device 102 is, for example, a four-way valve. However, the flow switching device 102 may be a plurality of three-way valves, a plurality of two-way valves, or other elements.

(Heat-Source-Side Heat Exchanger 103)

The heat-source-side heat exchanger 103 causes heat exchange to be performed between refrigerant and a heat medium that is, for example, ambient air or water. In the heating operation, the heat-source-side heat exchanger 103 operates as the evaporator and causes the refrigerant to evaporate and gasify. In the cooling operation, the heat-source-side heat exchanger 103 operates as the condenser or a radiator and causes the refrigerant to condense and liquefy.

(Heat-Source-Side Fan 106)

As in Embodiment 1, in the case where the heat-source-side heat exchanger 103 is an air-cooled heat exchanger, the heat-source-side unit 100 includes a fan, such as the heat-source-side fan 106. In order to control a condensing performance or an evaporating performance of the heat-source-side heat exchanger 103, for example, a controller 118 may control the rotation speed of the heat-source-side fan 106. In the case where the heat-source-side heat exchanger 103 is a water-cooled heat exchanger, the controller 118 controls the rotation speed of a water circulating pump (not illustrated), thereby controlling the condensing performance or the evaporating performance of the heat-source-side heat exchanger 103.

(First Expansion Device 107)

The first expansion device 107 has the function of a pressure reducing valve or an expansion valve, and decompresses and expands the refrigerant. The first expansion device 107 may be formed as an expansion device whose opening degree is variably controllable, for example, an elaborate flow-rate control device that is an electronic expansion valve or an inexpensive refrigerant flow-rate adjusting unit, such as a capillary tube.

The first expansion device 107 controls a pressure on an upstream side of the first expansion device 107 that is an intermediate pressure in the heating operation. It should be noted that the first expansion device 107 adjusts the pressure of refrigerant that flows through a bypass pipe 608, which will be described below. That is, the first expansion device 107 adjusts the difference between the pressure of refrigerant that has not yet passed through a third expansion device 602 provided at the bypass pipe 608 and the pressure of refrigerant that has passed through the third expansion device 602. In the case where the third expansion device 602 is fully opened, when it is required to increase the flow rate of refrigerant to be bypassed, the first expansion device 107 is operated to increase the difference between the pressure of refrigerant that has not yet passed through the third expansion device 602 and the pressure of refrigerant that has passed through the third expansion device 602, to thereby increase the flow rate of refrigerant to be bypassed.

(Accumulator 104)

The accumulator 104 is provided on a suction side of the compressor 101, and has a function of separating liquid refrigerant and gas refrigerant and a function of accumulating surplus refrigerant.

The heat-source-side unit 100 includes a high-pressure sensor 141 that detects the pressure of high-pressure refrigerant discharged from the compressor 101. Also, the heat-source-side unit 100 includes a low-pressure sensor 142 that detects the pressure of low-pressure refrigerant to be sucked into the compressor 101. The heat-source-side unit 100 further includes an outside temperature sensor 604 that detects an outside air temperature, a control temperature detector 605 that detects the temperature of the controller 118, and a suction-side temperature sensor 702 that detects the temperature of refrigerant to flow into the accumulator 104. The heat-source-side unit 100 further includes an opening-degree detector 602*a* that detects the opening degree of the third expansion device 602. Those sensors send signals related to the detected pressures and signals related to the detected temperatures to the controller 118, which is configured to control operations of the refrigeration cycle apparatus 500. The suction-side temperature sensor 702 and the low-pressure sensor 142 form a degree-of-superheat detector. It should be noted that any detector can be used as the degree-of-superheat detector as long as it can detect the degree of superheat at an outlet of a refrigerant cooler 603, and a temperature sensor that detects the temperature of refrigerant at an inlet of the refrigerant cooler 603 may be used in place of the low-pressure sensor 142.

(Load-Side Unit 300)

Each of the load-side units 300 supplies cooling energy or heating energy from the heat-source-side unit 100 to a cooling load or a heating load. For example, referring to FIG. 1, reference sings that denote the components included in the "load-side unit 300*a*" include the suffix a, and reference signs that denote the components included in the "load-side unit 300*b*" include the suffix b. In the following description, although the suffixes a and b may be omitted, the load-side units 300*a* and 300*b* include respective components.

The load-side units 300*a* and 300*b* are provided with load-side heat exchangers 312*a* and 312*b* and second expansion devices 311*a* and 311*b*, respectively. The load-side heat exchangers 312*a* and 312*b* and the second expansion devices 311*a* and 311*b* are connected in series, respectively, and form along with the heat-source-side unit 100 the refrigerant circuit. Furthermore, a fan (not illustrated) that supplies air to the load-side heat exchanger 312 may be provided. The load-side heat exchanger 312 may cause heat exchange to be performed between the refrigerant and a heat medium such as water, which is different from the refrigerant.

(Load-Side Heat Exchanger 312)

The load-side heat exchanger 312 causes heat exchange to be performed between the refrigerant and a heat medium, such as ambient air or water. In the heating operation, the load-side heat exchanger 312 operates as a condenser or a radiator to cause the refrigerant to condense and liquefy, and in the cooling operation, the load-side heat exchanger 312 operates as an evaporator to cause the refrigerant to evaporate and gasify. In general, the load-side heat exchanger 312 may be provided along with the fan (not illustrated), and the condensing performance or evaporating performance of the load-side heat exchanger 312 can be controlled by controlling the rotation speed of the fan. In Embodiment 1, each of the load-side heat exchangers 312*a* and 312*b* is provided as the load-side heat exchanger 312.

(Second Expansion Device 311)

The second expansion device 311 has the function of a pressure reducing valve or an expansion valve, and decompresses and expands the refrigerant. The second expansion device 311 may be an expansion device whose opening degree is variably controllable, and for example, an elaborate flow rate control device such as an electronic expansion valve or an inexpensive refrigerant flow-rate adjusting unit, such as a capillary tube. In Embodiment 1, each of the second expansion devices 311*a* and 311*b* is provided as the second expansion device 311.

The load-side units 300 include respective low-temperature-side pipe temperature sensors 314*a* and 314*b* each of which detects the temperature of a refrigerant pipe between the second expansion device 311 and the load-side heat exchanger 312. It should be noted that the low-temperature-side pipe temperature sensors 314*a* and 314*b* may be referred to as low-temperature-side pipe temperature sensors 314. The load-side units 300 includes respective high-temperature-side pipe temperature sensors 313*a* and 313*b* each of which detects the temperature of a refrigerant pipe between the load-side heat exchanger 312 and the flow switching device 102. It should be noted that the high-temperature-side pipe temperature sensors 313*a* and 313*b* may be referred to as high-temperature-side pipe temperature sensors 313. Temperature information detected by the above sensors is sent to the controller 118, which controls the operations of the refrigeration cycle apparatus 500, and are used in control of various actuators. That is, in each of the load-side units 300, temperature information from the high-temperature-side pipe temperature sensor 313 and the low-temperature-side pipe temperature sensor 314 is used in control of the opening degree of the second expansion device 311 included in the load-side unit 300, the rotation speed of the fan (not illustrated), and other factors.

(Refrigerant)

It should be noted that the kind of refrigerant for use in the refrigeration cycle apparatus 500 is not particularly limited. For example, as the refrigerant, one of the following kinds of refrigerants may be used: natural refrigerant such as carbon dioxide, hydrocarbon, or helium; alternative refrigerant that includes no chlorine, such as HFC410A, HFC407C, or HFC404A, and fluorocarbon refrigerant for use in an existing product, such as R22 or R134a.

FIG. 1 illustrates by way of example the case where the controller 118, which controls the operations of the refrigeration cycle apparatus 500, is provided in the heat-source-side unit 100. However, the controller 118 may be provided in the load-side unit 300. Alternatively, the controller 118 may be provided outside the heat-source-side unit 100 and the load-side units 300. The controller 118 may be divided into a plurality of controllers 118 having respective functions, and the controllers 118 may be assigned to the heat-source-side unit 100 and the load-side units 300; that is, the heat-source-side unit 100 and the load-side units 300 include respective controllers 118. In this case, it is preferable that the controllers 118 be connected to each other wirelessly or by a cable such that they can communicate with each other.

(Bypass Pipe 608)

The heat-source-side unit 100 further includes the bypass pipe 608, The bypass pipe 608 branches off from the liquid pipe 402 between the first expansion device 107 and the second expansion device 311, and is connected to a low-pressure pipe 610 on the suction side of the compressor 101. Liquid refrigerant or two-phase gas-liquid refrigerant that flows in the liquid pipe 402 is bypassed; that is, the liquid refrigerant or two-phase gas-liquid refrigerant is made to flow into the bypass pipe 608. At the bypass pipe 608, the third expansion device 602 and the refrigerant cooler 603 are provided. The third expansion device 602 adjusts the flow rate of the bypassed refrigerant, and the refrigerant cooler 603 cools the controller 118.

(Third Expansion Device 602)

The third expansion device 602 has the function of a pressure reducing valve or an expansion valve, and decompresses and expands the refrigerant. The third expansion device 602 further decompresses the refrigerant that has been cooled in the heat-source-side heat exchanger 103 or the load-side heat exchanger 312 and that has been decompressed in the first expansion device 107 or the second expansion device 311. The third expansion device 602 has a function of causing the refrigerant, with the temperature of the refrigerant further lowered, to flow into the refrigerant cooler 603. The third expansion device 602 is an expansion device whose opening degree is variably controllable, such as an electronic expansion valve.

(Refrigerant Cooler 603)

The refrigerant cooler 603 includes a refrigerant pipe that allows the refrigerant to pass therethrough and that is provided in contact with the controller 118. The refrigerant that has flowed into the bypass pipe 608 flows into the refrigerant cooler 603 at a flow rate adjusted by the third expansion device 602. The liquid refrigerant that has flowed into the refrigerant cooler 603 receives heat generated in the controller 118 to change into gas refrigerant. The gas refrigerant passes through a downstream-side pipe 609 located on a downstream side and flows into the accumulator 104 through the low-pressure pipe 610.

Figure 2:
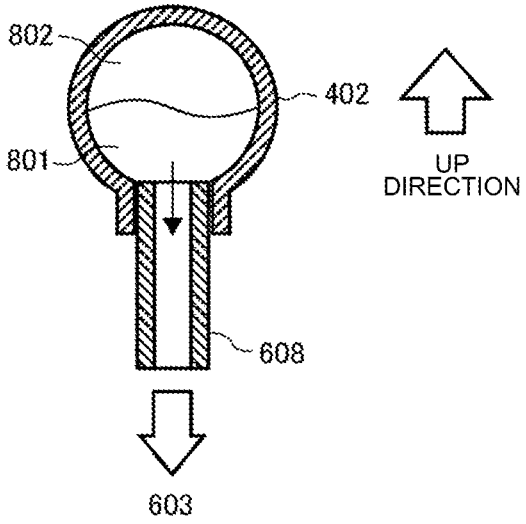
FIG. 2 is a schematic sectional view illustrating a connection between a liquid pipe and a bypass pipe in the refrigeration cycle apparatus according to Embodiment 1.

FIG. 2 is a schematic sectional view illustrating a connection between the liquid pipe 402 and the bypass pipe 608 in the refrigeration cycle apparatus 500 according to Embodiment 1. Next, the connection between the liquid pipe 402 and the bypass pipe 608 will be described. As illustrated in FIG. 2, the bypass pipe 608 is connected to lower part of the liquid pipe 402. Specifically, the bypass pipe 608 is located at a lower position than a horizontal plane in which the liquid pipe 402 is located.

In the case where the refrigerant that flows in the liquid pipe 402 is the two-phase gas-liquid refrigerant, it is a mixture of liquid refrigerant and gas refrigerant. In this case, as illustrated in FIG. 2, refrigerant 801 that is the liquid refrigerant remains in the lower part of the liquid pipe 402, and refrigerant 802 that is the gas refrigerant remains in upper part of the liquid pipe 402. In order that the controller 118 be cooled by the refrigerant, it is necessary that the refrigerant be the liquid refrigerant. In Embodiment 1, because the bypass pipe 608 is connected to the lower part of the liquid pipe 402, refrigerant that is bypassed to flow into the bypass pipe 608 is the liquid refrigerant 801. Thus, in Embodiment 1, because the liquid refrigerant 801, whose enthalpy is low, can be bypassed, even if the difference between the pressure of the refrigerant that has not yet passed through the third expansion device 602 and that of the refrigerant that has passed through the third expansion device 602 is small, and the flow rate of the refrigerant is low, it is possible to ensure the cooling performance required for cooling the controller 118.

(Controller 118)

Figure 3:
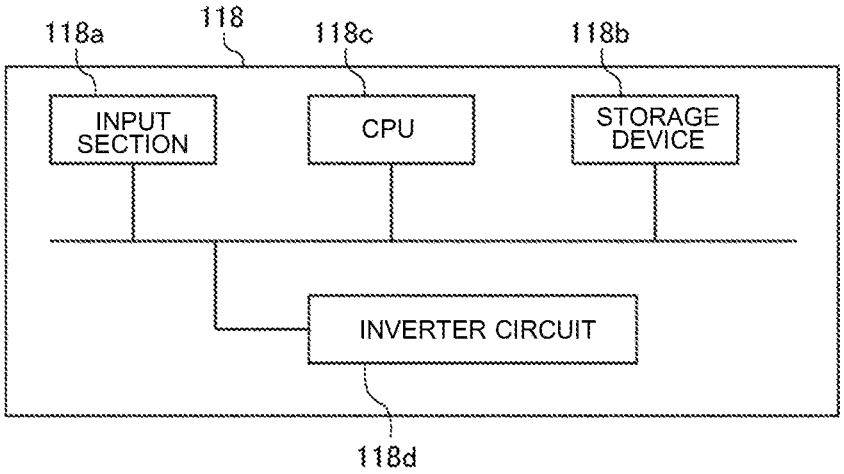
FIG. 3 is a hardware configuration diagram illustrating a controller in the refrigeration cycle apparatus according to Embodiment 1.

FIG. 3 is a hardware configuration diagram illustrating the controller 118 in the refrigeration cycle apparatus 500 according to Embodiment 1, As illustrated in FIG. 3, the controller 118 is a CPU 118*c* (central processing unit, also referred to as a processing unit, an arithmetic unit, a microprocessor, a microcomputer, or a processor) that executes a program input from an input section 118*a* and stored in dedicated hardware or a storage device 118*b* and drives an inverter circuit 118*d*. In the case where the controller 118 is the dedicated hardware, the controller 118 corresponds to, for example, a single circuit, a composite circuit, an application specific integrated circuit (ASIC), a field-programmable gate array (FPGA), or combinations of these circuits. Each of the functions to be fulfilled the controller 118 may be fulfilled by respective hardware or may be fulfilled by single hardware.

In the case where the controller 118 is the CPU 118*c*, the functions to be fulfilled by the controller 118 are fulfilled by software, firmware, or a combination of software and firmware. The software and firmware are described as a program, and the program is stored in the storage device 118*b*. The CPU 118*c* reads the program from the storage device 118*b* and executes the program, thereby fulfilling the functions. Some functions of the controller 118 may be fulfilled by dedicated hardware, and other functions of the controller 118 may be fulfilled by software or firmware. The controller 118 may be formed as a hard disk, or may be formed as a volatile storage device, such as a random access memory (RAM), which can temporarily store data. The storage device 118*b* may be formed as a nonvolatile storage device, such as a flash memory, which can store data for a long time. It should be noted that in Embodiment 1, the controller 118 is provided in the heat-source-side unit 100; however, the controller 118 may be provided at any location as long as it can control components, etc.

The controller 118 controls, for example, the driving frequency of the compressor 101, the rotation speed of the heat-source-side fan 106, and a switching operation of the flow switching device 102 on the basis of a high pressure and a low pressure. The controller 118 decreases the opening degree of the first expansion device 107, when the temperature detected by the control temperature detector 605 is higher than or equal to a temperature threshold, and the opening degree of the third expansion device 602 detected by the opening-degree detector 602*a* is higher than or equal to an opening-degree threshold. The controller 118 controls the third expansion device 602 on the basis of the pressure and temperature detected by the sensors.

The controller 118 decreases the opening degree of the first expansion device 107 when the degree of superheat that is detected by the degree-of-superheat detector is lower than or equal to a degree-of-superheat threshold.

Next, operations of the refrigeration cycle apparatus 500 will be described. The refrigeration cycle apparatus 500 receives a cooling request or a heating request from a remote controller or other components provided in, for example, an indoor space. In response to this request, the refrigeration cycle apparatus 500 performs one of air-conditioning operations corresponding to two operation modes. The two operation modes are a cooling operation mode and a heating operation mode.

(Cooling Operation Mode)

Figure 4:
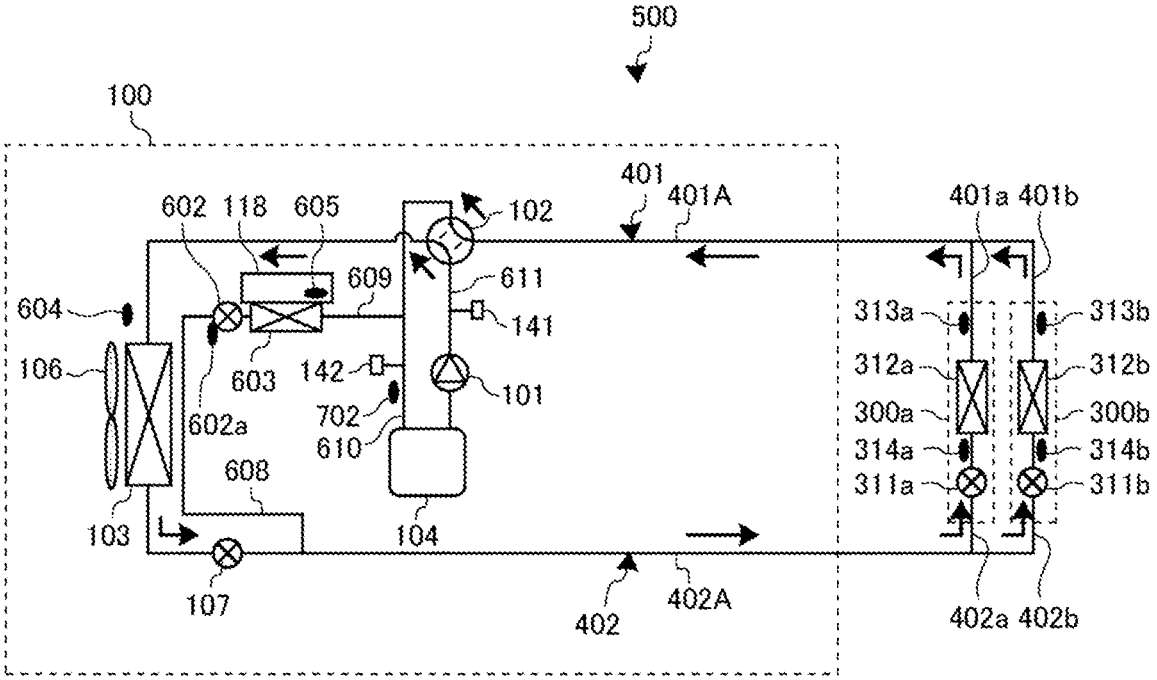
FIG. 4 is a circuit diagram illustrating the flow of refrigerant in a cooling operation mode in the refrigeration cycle apparatus according to Embodiment 1.

FIG. 4 is a circuit diagram indicating the flow of the refrigerant in the cooling operation mode in the refrigeration cycle apparatus 500 according to Embodiment 1. It will be described with reference to FIG. 4 how the refrigeration cycle apparatus 500 is operated in the cooling operation mode.

As illustrated in FIG. 4, the compressor 101 compresses low-temperature and low-pressure refrigerant to change it into high-temperature and high-pressure gas refrigerant, and discharges the high-temperature and high-pressure gas refrigerant.

The high-temperature and high-pressure gas refrigerant discharged from the compressor 101 flows through a high-pressure pipe 611 and the flow switching device 102 and flows into the heat-source-side heat exchanger 103. Since the heat-source-side heat exchanger 103 operates as a condenser, the refrigerant exchanges heat with ambient air sent from the heat-source-side fan 106, and condenses to change into liquid refrigerant. After flowing out of the heat-source-side heat exchanger 103, the liquid refrigerant is decompressed by the first expansion device 107. The decompressed refrigerant passes through the liquid main pipe 402A and flows out of the heat-source-side unit 100.

The liquid refrigerant that has flowed out of the heat-source-side unit 100 flows through the liquid branch pipes 402*a* and 402*b* and flows into the load-side units 300*a* and 300*b*. The liquid refrigerant that has flowed into the load-side units 300*a* and 300*b* is decompressed in the second expansion devices 311*a* and 311*b* to change into low-temperature two-phase gas-liquid refrigerant. The low-temperature two-phase gas-liquid refrigerant flows into the load-side heat exchangers 312*a* and 312*b*. Since the load-side heat exchangers 312*a* and 312*b* operate as evaporators, the refrigerant exchanges heat with ambient air, and evaporates to change into gas refrigerant. At that time, the refrigerant receives heat from the surrounding areas, whereby air-conditioning target space, such as indoor space, is cooled. Then, after flowing out of the load-side heat exchangers 312*a* and 312*b*, the refrigerant passes through the gas branch pipes 401*a* and 401*b* and flows out of the load-side units 300*a* and 300*b*.

The refrigerant that has flowed out of the load-side units 300*a* and 300*b* passes through the gas main pipe 401A and returns to the heat-source-side unit 100. The gas refrigerant that has returned to the heat-source-side unit 100 is re-sucked into the compressor 101 through the flow switching device 102 and the accumulator 104, In the above flow, the refrigeration cycle apparatus 500 performs the cooling operation in the cooling operation mode.

(Heating Operation Mode)

Figure 5:
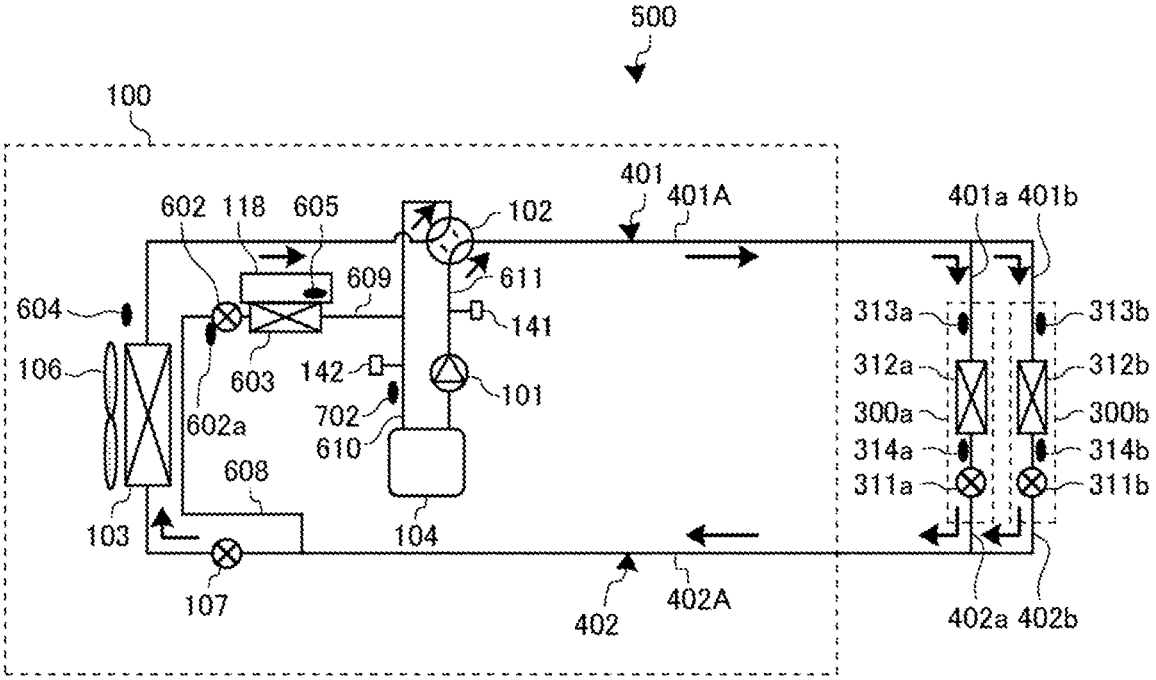
FIG. 5 is a circuit diagram illustrating the flow of the refrigerant in a heating operation mode in the refrigeration cycle apparatus according to Embodiment 1.

FIG. 5 is a circuit diagram illustrating the flow of the refrigerant in the heating operation mode in the refrigeration cycle apparatus 500 according to Embodiment 1. It will be described with reference to FIG. 5 how the refrigeration cycle apparatus 500 is operated in the heating operation mode.

As illustrated in FIG. 5, the compressor 101 compresses low-temperature and low-pressure refrigerant to change it into high-temperature and high-pressure gas refrigerant and discharges the high-temperature and high-pressure gas refrigerant. The high-temperature and high-pressure gas refrigerant discharged from the compressor 101 flows through the high-pressure pipe 611 and the flow switching device 102 and flows into the gas pipe 401. Thereafter, the high-temperature and high-pressure gas refrigerant flows out of the heat-source-side unit 100. The high-temperature and high-pressure gas refrigerant that has flowed out of the heat-source-side unit 100 flows through the gas branch pipes 401*a* and 401*b* and flows into the load-side units 300*a* and 300*b*.

The gas refrigerant that has flowed into the load-side units 300*a* and 300*b* flows into the load-side heat exchangers 312*a* and 312*b*. Since the load-side heat exchangers 312*a* and 312*b* operate as condensers, the refrigerant exchanges heat with ambient air, and condenses to change into liquid refrigerant. At this time, the refrigerant transfers heat to the surrounding area, whereby the air-conditioning target space, such as the indoor space, is heated. After that, after flowing out of the load-side heat exchangers 312*a* and 312*b*, the liquid refrigerant is decompressed in the second expansion devices 311*a* and 311*b*, passes through the liquid branch pipes 402*a* and 402*b*, and flows out of the load-side units 300*a* and 300*b*.

The refrigerant that has flowed out of the load-side units 300*a* and 300*b* passes through the liquid main pipe 402A and returns to the heat-source-side unit 100. The gas refrigerant that has returned to the heat-source-side unit 100 flows into the heat-source-side heat exchanger 103. Since the heat-source-side heat exchanger 103 operates as an evaporator, the refrigerant exchanges heat with ambient air sent from the heat-source-side fan 106, and evaporates to change into gas refrigerant. After that, after flowing out of the heat-source-side heat exchanger 103, the refrigerant flows into the accumulator 104 through the flow switching device 102. The refrigerant in the accumulator 104 is sucked by the compressor 101, and is circulated in the refrigerant circuit, thereby achieving the refrigeration cycle. In the above flow, the refrigeration cycle apparatus 500 performs the heating operation in the heating operation mode.

(Refrigerant Cooling Control)

Next, refrigerant cooling control of cooling the controller 118 using the refrigerant will be described.

The refrigerant cooling control is control of cooling the controller 118 using the refrigerant, and the refrigerant cooling control in the cooling operation mode is similar to that in the heating operation mode.

Figure 6:
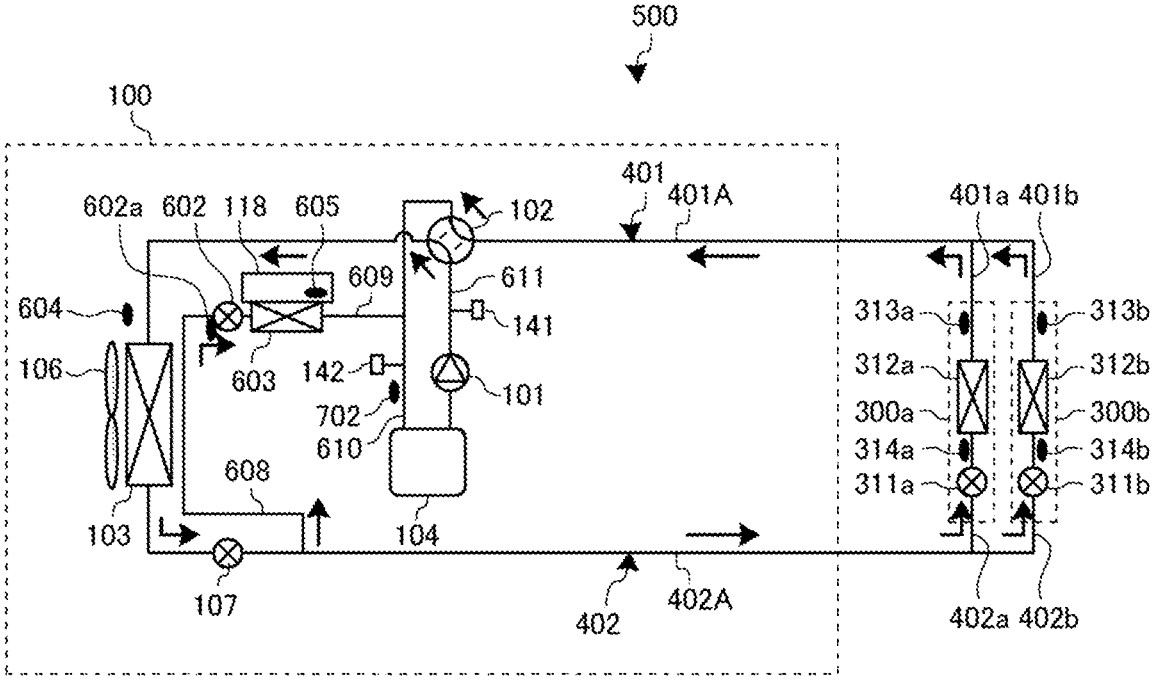
FIG. 6 is a circuit diagram illustrating the flow of the refrigerant in the cooling operation mode in a refrigerant cooling control in the refrigeration cycle apparatus according to Embodiment 1.

FIG. 6 is a circuit diagram indicating the flow of the refrigerant in the cooling operation mode in the refrigerant cooling control in the refrigeration cycle apparatus 500 according to Embodiment 1. First of all, the refrigerant cooling control will be described with reference to the figure illustrating the flow of the refrigerant in the cooling operation mode.

(Control of Third Expansion Device 602)

As illustrated in FIG. 6, in the refrigerant cooling control, the third expansion device 602 is opened, whereby part of the liquid refrigerant or the two-phase gas-liquid refrigerant that is decompressed by the first expansion device 107 and flows in the liquid pipe 402 is bypassed to flow into the bypass pipe 608. The bypassed refrigerant is decompressed by the third expansion device 602 such that the pressure of the refrigerant is reduced to a lower pressure, and the refrigerant then flows into the refrigerant cooler 603. The refrigerant that has flowed into the refrigerant cooler 603 exchanges heat with the controller 118 and evaporates. The refrigerant that has cooled the controller 118 changes into gas refrigerant or two-phase gas-liquid refrigerant, and the gas refrigerant or two-phase gas-liquid refrigerant flows into the downstream-side pipe 609 and the low-pressure pipe 610 and flows into the accumulator 104.

Figure 7:
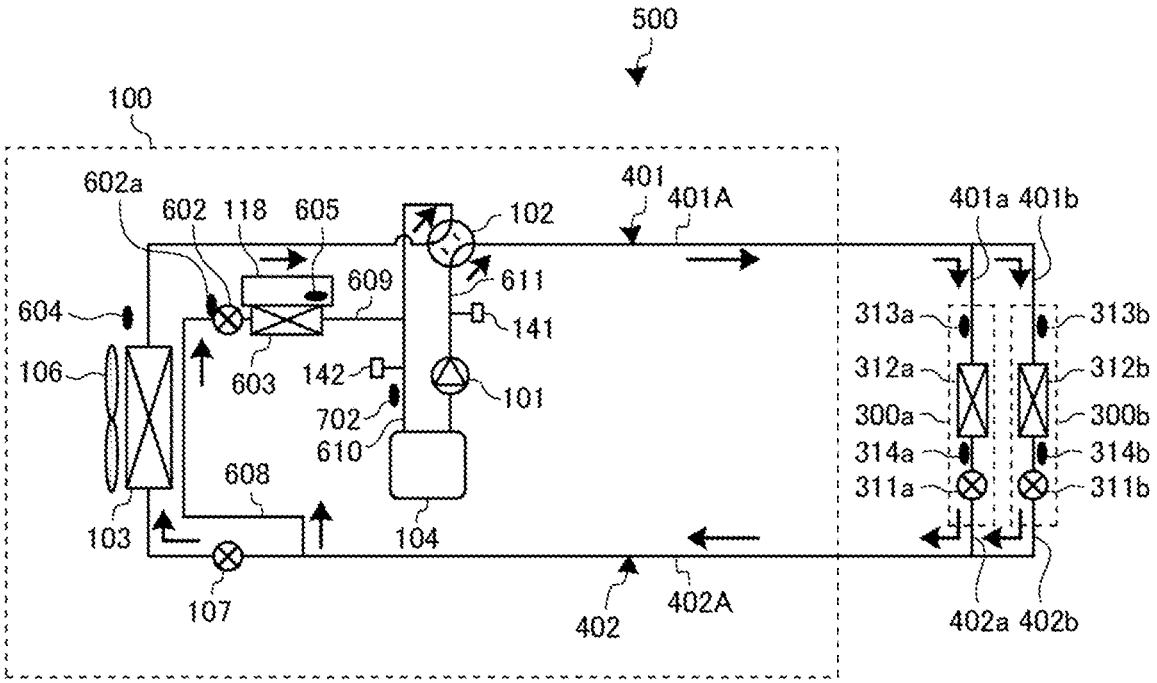
FIG. 7 is a circuit diagram illustrating the flow of the refrigerant in the heating operation mode in the refrigerant cooling control in the refrigeration cycle apparatus according to Embodiment 1.

FIG. 7 is a circuit diagram indicating the flow of the refrigerant in the heating operation mode in the refrigerant cooling control in the refrigeration cycle apparatus 500 according to Embodiment 1. Next, the refrigerant cooling control will be described with reference to the figure indicating the flow of the refrigerant in the heating operation mode.

As illustrated in FIG. 7, in the refrigerant cooling control, the third expansion device 602 is opened, whereby part of the liquid refrigerant or the two-phase gas-liquid refrigerant that is decompressed by the second expansion device 311 and flows through the liquid pipe 402 is bypassed to flow into the bypass pipe 608. The bypassed refrigerant is decompressed by the third expansion device 602 such that the pressure of the refrigerant is lowered to a lower pressure, and the refrigerant then flows into the refrigerant cooler 603. The refrigerant that has flowed into the refrigerant cooler 603 exchanges heat with the controller 118 and evaporates. The refrigerant that has cooled the controller 118 changes into gas refrigerant or two-phase gas-liquid refrigerant, and the gas refrigerant or two-phase gas-liquid refrigerant flows into the downstream-side pipe 609 and the low-pressure pipe 610 and flows into the accumulator 104.

The flow rate of the refrigerant that flows in the refrigerant cooler 603 is adjusted by the third expansion device 602. The third expansion device 602 is controlled by the controller 118 on the basis of information obtained from the low-pressure sensor 142, the control temperature detector 605, the suction-side temperature sensor 702, and the outside temperature sensor 604. Specific control of the third expansion device 602 will be described below.

Figure 8:
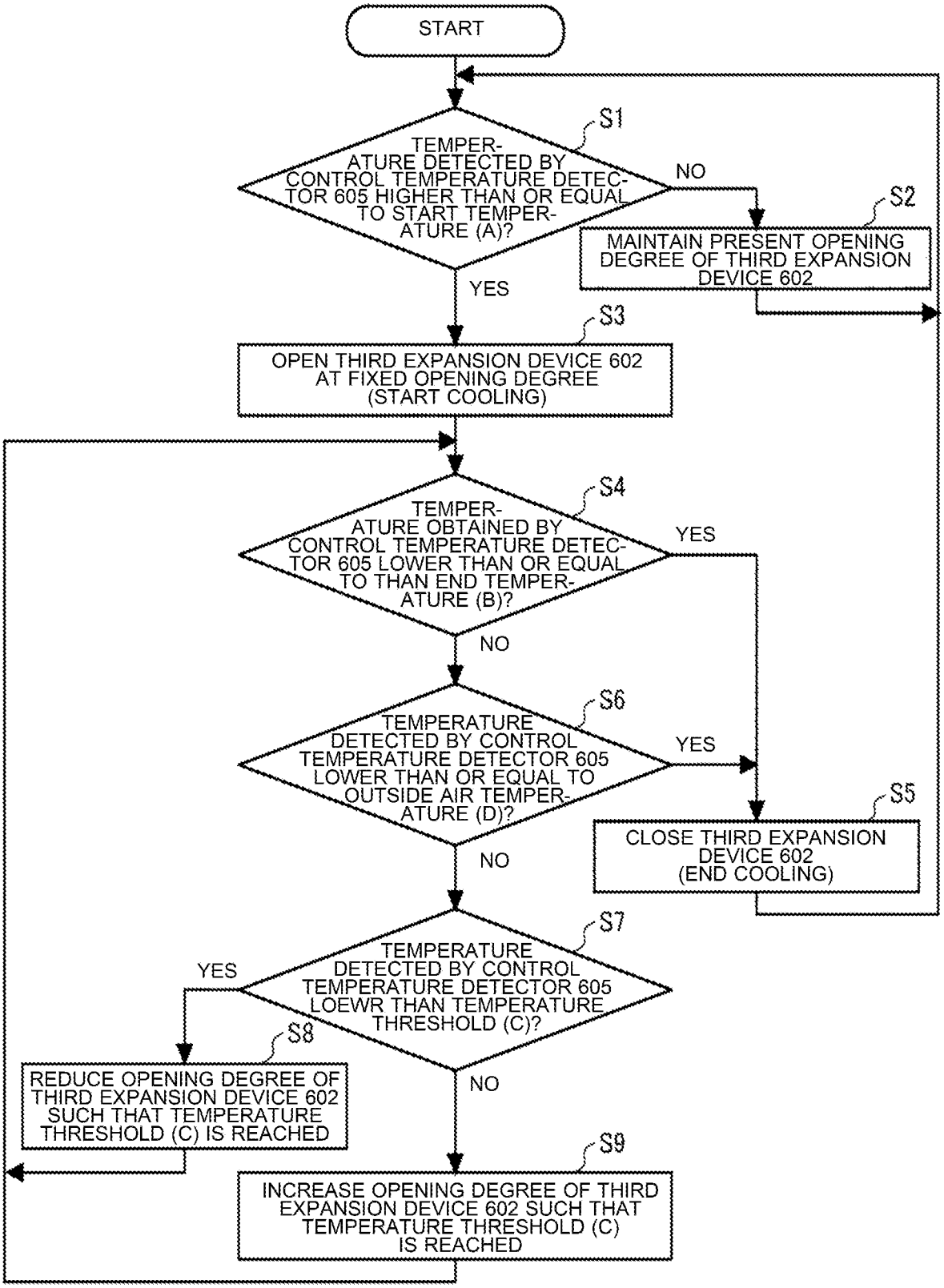
FIG. 8 is a flowchart illustrating control of a third expansion device in the refrigerant cooling control in the refrigeration cycle apparatus according to Embodiment 1.
Figure 9:
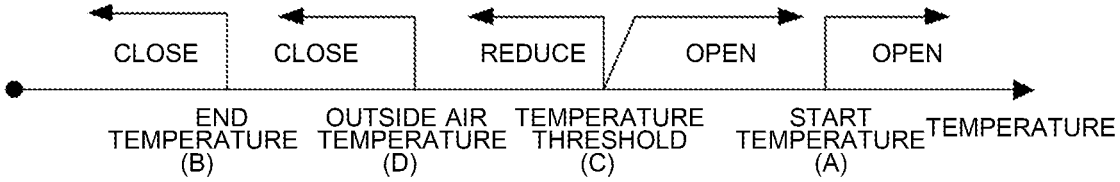
FIG. 9 indicates a summary of operations of the third expansion device based on the flowchart of FIG. 8.

FIG. 8 is a flowchart indicating control of the third expansion device 602 in the refrigerant cooling control in the refrigeration cycle apparatus 500 according to Embodiment 1. FIG. 9 indicates a summary of operations of the third expansion device 602 based on the flowchart of FIG. 8. In the following description, temperatures (A) to (D) satisfy (B)<(D)<(C)<(A).

As indicated in FIGS. 8 and 9, in an initial state, the third expansion device 602 is in a closed state. After an operation of the refrigeration cycle apparatus 500 starts, the controller 118 determines whether the temperature detected by the control temperature detector 605 is higher than or equal to a start temperature (A) determined in advance, for example, 75 degrees C. (step S1). When the detected temperature is lower than the start temperature (A) (No in step S1), it is not necessary to cool the controller 118, and the present opening degree of the third expansion device 602 is thus maintained, that is, the third expansion device 602 is kept in the closed state (step S2), thereby preventing the refrigerant from flowing into the refrigerant cooler 603. By contrast, when the detected temperature by the control temperature detector 605 is higher than or equal to the start temperature (A) (Yes in step S1), the controller 118 opens the third expansion device 602 to a fixed opening degree determined in advance (step S3). Thus, the refrigerant flows into the refrigerant cooler 603, and starts cooling the controller 118, whereby the temperature of the controller 118 is lowered.

The controller 118 checks the temperature detected by the control temperature detector 605 and determines whether this detected temperature is lower than or equal to an end temperature (B) determined in advance, for example (step S4). When the temperature detected by the control temperature detector 605 is lower than or equal to the end temperature (B) (Yes at step S4), the controller 118 closes the third expansion device 602 and ends the cooling of the controller 118 (step S5), and the processing returns to step S1. By contrast, when the temperature detected by the control temperature detector 605 is higher than the end temperature (B) (No at step S4), it is necessary to continue the cooling, and the controller 118 thus determines whether the temperature detected by the control temperature detector 605 is lower than or equal to an outside air temperature (D) (step S6). This determination is made to prevent condensation from occurring at the controller 118.

When the temperature detected by the control temperature detector 605 drops to the outside air temperature (D) or below (Yes in step S6), condensation will occur at the controller 118, the controller 118 thus closes the third expansion device 602 and ends the cooling of the controller 118 (step S5), and the processing returns to step S1. By contrast, when the temperature detected by the control temperature detector 605 is higher than the outside air temperature (0) (No in step S6), the controller 118 determines whether the temperature detected by the control temperature detector 605 is lower than a temperature threshold (C) that is a target temperature determined in advance, for example, 60 degrees C. (step S7).

When the temperature detected by the control temperature detector 605 is lower than the temperature threshold (C) (Yes at step S7), the controller 118 reduces the opening degree of the third expansion device 602 such that the temperature of the controller 118 reaches the temperature threshold (C) (step S8), and the processing returns to the determination at step S4. It should be noted that when the temperature detected by the control temperature detector 605 is equal to the temperature threshold (C), the present opening degree may be maintained. When the temperature detected by the control temperature detector 605 is higher than or equal to the temperature threshold (C) (No in step S7), in order that the cooling be continued, the controller 118 increases the opening degree of the third expansion device 602 such that the temperature detected by the control temperature detector 605 reaches the temperature threshold (C) (step S9). It should be noted that in the case where the present opening degree of the third expansion device 602 is maintained, when the temperature detected by the control temperature detector 605 tends to drop, the controller 118 maintains the present opening degree of the third expansion device 602. The processing returns to step S4, and the same processes as described above are repeated.

(Control of First Expansion Device 107)

Next, control of the first expansion device 107 will be described.

Figure 10:
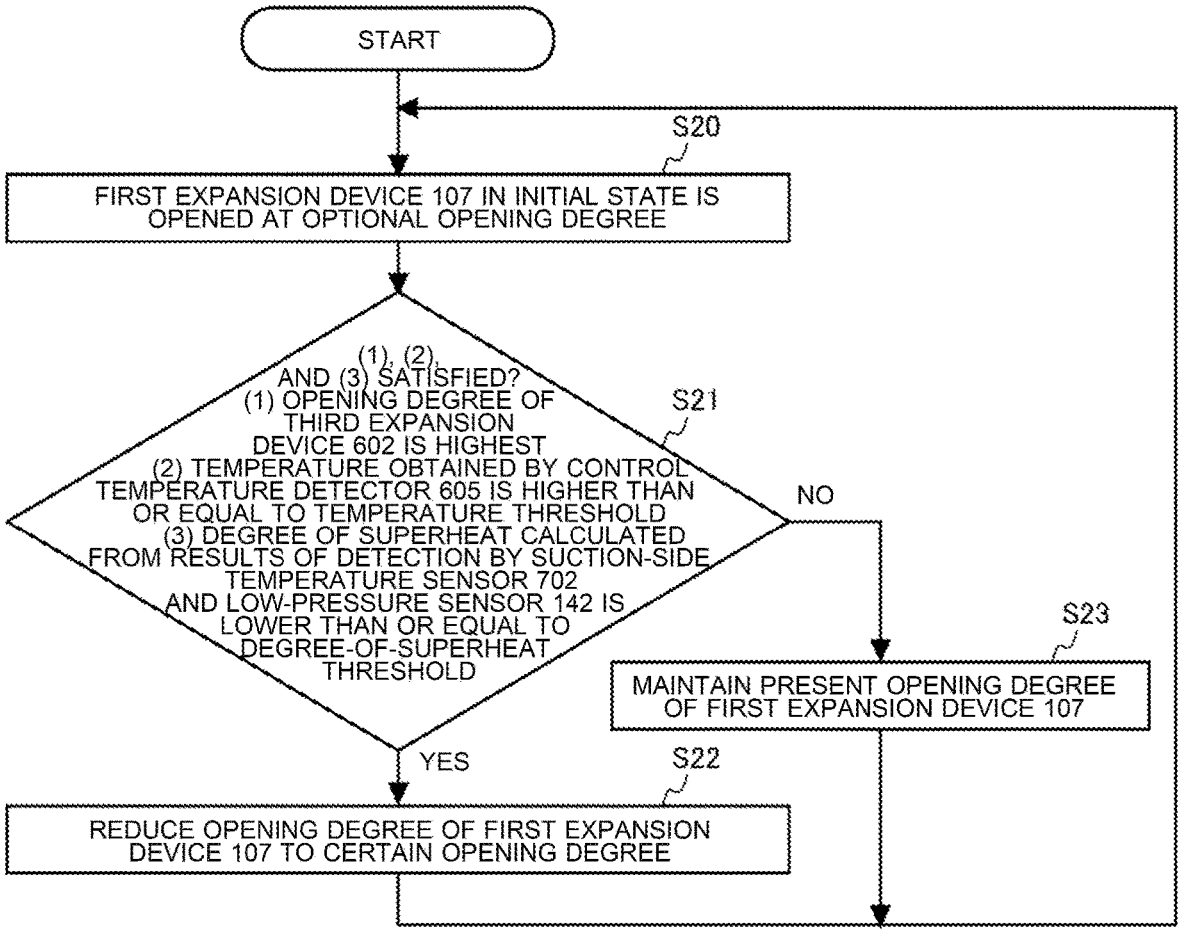
FIG. 10 is a flowchart indicating control of a first expansion device in the refrigerant cooling control in the refrigeration cycle apparatus according to Embodiment 1.

FIG. 10 is a flowchart indicating control of the first expansion device 107 in the refrigerant cooling control in the refrigeration cycle apparatus 500 according to Embodiment 1. As indicated in FIG. 10, in an initial state, the first expansion device 107 is in an opened state at an optional opening degree (step S20). The controller 118 first starts the operation of the refrigeration cycle apparatus 500 and then controls the third expansion device 602 according to the flowchart of FIG. 8. In the flowchart of FIG. 8, when the temperature detected by the control temperature detector 605 is higher than or equal to the temperature threshold (C) (No in step S7 in FIG. 8), control of increasing the opening degree of the third expansion device 602 is performed (step S9 in FIG. 8). In the case where the temperature detected by the control temperature detector 605 does not drop even when the opening degree of the third expansion device 602 is increased, the opening degree of the third expansion device 602 is continuously increased to the highest opening degree thereof.

When the third expansion device 602 is opened to the highest opening degree, it becomes impossible to adjust the flow rate of refrigerant bypassed, solely by adjusting the opening degree of the third expansion device 602. Therefore, in Embodiment 1, the flow rate of refrigerant to be bypassed is increased by controlling the first expansion device 107 such that the difference between the pressure of refrigerant that has not yet passed through the third expansion device 602 and that of refrigerant that has passed through the third expansion device 602 is increased.

The controller 118 determines whether the temperature detected by the control temperature detector 605 is higher than or equal to the temperature threshold, whether the opening degree of the third expansion device 602 is higher than or equal to the opening-degree threshold, for example, it is the highest, and whether the degree of superheat detected by the degree-of-superheat detector is smaller or lower than the degree-of-superheat threshold (step S21). When all the above conditions are satisfied (Yes at step S21), a reduction operation of reducing the opening degree of the first expansion device 107 from the present opening degree to a certain opening degree is performed (step S22). It should be noted that the degree of superheat is calculated based on the pressure detected by the low-pressure sensor 142 and the temperature detected by the suction-side temperature sensor 702. The degree of superheat may be calculated based on the result of detection by another sensor. After that, the same determination control as described above is repeated at regular intervals. The condition for the opening degree of the third expansion device 602 is not limited to the condition that the opening degree is the highest and may be the condition that the opening degree is higher than or equal to the opening-degree threshold.

It will be described why the following condition is adopted: the degree of superheat calculated from the results of detection by the suction-side temperature sensor 702 and the low-pressure sensor 142 is lower than or equal to the degree-of-superheat threshold. The adoption of the above condition is intended to reduce the possibility that the heating capacity will become insufficient due to reduction of the opening degree of the first expansion device 107, Generally, when the opening degree of the first expansion device 107 is reduced, the quality of the liquid pipe 402 from the load-side unit 300 to the first expansion device 107 is decreased and the pressure of the liquid pipe 402 is increased, whereby the refrigerant density in the liquid pipe 402 is increased, and in the system, refrigerant excessively concentratedly flows in the liquid pipe 402.

When in the system, refrigerant excessively concentratedly flows in the liquid pipe 402 and the refrigerant that flows through the other pipes becomes insufficient, the heating capacity is reduced. Therefore, as an index for ensuring that the refrigerant flowing through the other pipes is not insufficient, the following condition is applied: the degree of superheat calculated from the results of detection by the suction-side temperature sensor 702 and the low-pressure sensor 142 is lower than or equal to the degree-of-superheat threshold. When the above condition is satisfied, the opening degree of the first expansion device 107 is reduced. It should be noted that when it is expected that refrigerant will not excessively concentratedly flow in the above manner, from the conditions for reducing the opening degree of the first expansion device 107, the condition that the degree of superheat is lower than or equal to the degree-of-superheat threshold may be omitted.

When at least one of the above conditions is not satisfied (No at step S21), the controller 118 maintains the present opening degree of the first expansion device 107 (step S23). After that, the same determination control as described above are repeated at regular intervals.

By the above refrigerant cooling control, the controller 118 is cooled. The specific numerical values of the temperatures in the above description are examples and may be changed as appropriate depending on conditions in actual use or other factors.

According to Embodiment 1, the bypass pipe 608, at which the refrigerant cooler 603 configured to cool the controller 118 is provided, bypasses the liquid pipe 402 between the first expansion device 107 and the third expansion device 602 and the suction side of the compressor 101. Thus, the refrigerant discharged from the compressor 101 flows to the heat-source-side heat exchanger 103 or the load-side heat exchanger 312 without being bypassed. Therefore, it is possible to avoid a loss in the capacity that would occur if the refrigerant discharged from the compressor 101 were bypassed. Accordingly, it is possible to reduce a decrease in the heating and cooling capacity.

In the heating operation, all the refrigerant discharged from the compressor 101 contributes to heating of air-conditioning target space. Furthermore, in the heating operation, because the evaporating performance of the refrigerant cooler 603 that is obtained from the cooling of the controller 118 can be added to the evaporating performance of the heat-source-side heat exchanger 103, the heating capacity can be improved. This is remarkable in the case where the controller 118 uses a component that generates a large amount of heat, such as an inverter. In this case, because the amount of heat of the controller 118 is large, the refrigerant is correspondingly evaporated by the refrigerant cooler 603.

Furthermore, since the bypass pipe 608 is connected to the liquid pipe 402, refrigerant that flows through the bypass pipe 608 has already been condensed by the heat-source-side heat exchanger 103 or the load-side heat exchanger 312. Therefore, it is not necessary to further provide an additional condenser at the bypass pipe 608. Accordingly, it is not necessary to assign part of the heat-source-side heat exchanger 103 as a condenser for the bypass pipe 608. Thus, the entire capacity of the heat-source-side heat exchanger 103 can be used in heating and cooling, and the refrigerant circuit can thus be simplified.

The refrigeration cycle apparatus 500 further includes the control temperature detector 605 that detects the temperature of the controller 118 and the opening-degree detector 602*a* that detects the opening degree of the third expansion device 602. When the temperature detected by the control temperature detector 605 is higher than or equal to the temperature threshold, and the opening degree of the third expansion device 602 detected by the opening-degree detector 602*a* is higher than or equal to the opening-degree threshold, the controller 118 reduces the opening degree of the first expansion device 107. Thus, even when it becomes hard for the third expansion device 602 to adjust the flow rate of the refrigerant that flows through the bypass pipe 608, the first expansion device 107 can adjust the flow rate of the refrigerant that flows through the bypass pipe 608 in place of the third expansion device 602.

The refrigeration cycle apparatus 500 further includes the degree-of-superheat detector that detects the degree of superheat on the suction side of the compressor 101, and in addition, when the degree of superheat detected by the degree-of-superheat detector is equal to or less than the degree-of-superheat threshold, the controller 118 decreases the opening degree of the first expansion device 107. By decreasing the opening degree of the first expansion device 107 after confirming that the refrigerant flowing through pipes other than the liquid pipe 402 is not insufficient, it is possible to reduce the decrease in the heating and cooling capacity.

Moreover, the bypass pipe 608 is connected to lower part of the liquid pipe 402. Therefore, liquid refrigerant whose enthalpy is low can be bypassed. Accordingly, even when the difference between the pressure of refrigerant that has not yet passed through the third expansion device 602 and that of refrigerant that has passed through the third expansion device 602 is small and the flow rate of the refrigerant is low, it is possible to ensure a cooling performance required for cooling the controller 118.

Regarding Embodiment 1, the refrigeration cycle apparatus 500 including one heat-source-side unit 100 and two load-side units 300 is illustrated as an example; however, the number of heat-source-side units 100 and that of two load-side units 300 are not limited. Furthermore, the above description regarding Embodiment 1 refers to the refrigeration cycle apparatus 500 in which the operation of each of the load-side units 300 can be switched to one of the cooling operation and the heating operation. However, the apparatus to which the above control is applied is not limited to the above refrigeration cycle apparatus. As other apparatuses to which evaporation control is applicable, for example, the following apparatuses are present: the refrigeration cycle apparatus 500 in which a load is heated by supply of capacity; and an apparatus including a refrigerant circuit using a refrigeration cycle such as a refrigeration system.

In addition, regarding Embodiment 1, it is described above that the refrigeration cycle apparatus 500 is an air-conditioning apparatus, but the refrigeration cycle apparatus 500 may be a cooling apparatus that cools a cold storage and refrigerated warehouse or other space.

REFERENCE SIGNS LIST

100: heat-source-side unit, 101: compressor, 102: flow switching device, 103: heat-source-side heat exchanger, 104: accumulator, 106: heat-source-side fan, 107: first expansion device, 118: controller, 118*a*: input section, 118*b*: storage device, 118*c*: CPU, 118*d*: inverter circuit, 141: high-pressure sensor, 142: low-pressure sensor, 300, 300*a*, 300*b*: load-side unit, 311, 311*a*, 311*b*: second expansion device, 312, 312*a*, 312*b*: load-side heat exchanger, 313, 313*a*, 313*b*: high-temperature-side pipe temperature sensor, 314, 314*a*, 314*b*: low-temperature-side pipe temperature sensor, 401: gas pipe, 401A: gas main pipe, 401*a*: gas branch pipe, 401*b*: gas branch pipe, 402: liquid pipe, 402A: liquid main pipe, 402*a*: liquid branch pipe, 402*b*: liquid branch pipe, 500: refrigeration cycle apparatus, 602: third expansion device, 602*a*: opening-degree detector, 603: refrigerant cooler, 604: outside temperature sensor, 605: control temperature detector, 608: bypass pipe, 609: downstream-side pipe, 610: low-pressure pipe, 611: high-pressure pipe, 702: suction-side temperature sensor, 801: refrigerant, 802: refrigerant

The invention claimed is:

1. A refrigeration cycle apparatus comprising:

a refrigerant circuit in which a compressor, a heat-source-side heat exchanger, a first expansion device, a second expansion device, and a load-side heat exchanger are sequentially connected by refrigerant pipes and in which refrigerant is circulated;

a controller configured to control the refrigerant circuit;

a bypass pipe extending from a liquid pipe between the first expansion device and the second expansion device toward a suction side of the compressor;

a third expansion device provided at the bypass pipe, and configured to decompress the refrigerant that flows through the bypass pipe;

a refrigerant cooler provided at the bypass pipe and downstream of the third expansion device, and configured to cause heat exchange to be performed between the refrigerant decompressed by the third expansion device and heat generated from the controller;

a control temperature detector configured to detect a temperature of the controller; and an opening-degree detector configured to detect an opening degree of the third expansion device, wherein when the temperature detected by the control temperature detector is higher than or equal to a temperature threshold, and the opening degree of the third expansion device detected by the opening-degree detector is higher than or equal to an opening-degree threshold, the controller decreases an opening degree of the first expansion device.

2. The refrigeration cycle apparatus of claim 1, further comprising:

a degree-of-superheat detector configured to detect a degree of superheat on the suction side of the compressor, wherein when it is further satisfied that the degree of superheat detected by the degree-of-superheat detector is lower than or equal to a degree-of-superheat threshold, the controller decreases the opening degree of the first expansion device.

3. The refrigeration cycle apparatus of claim 1, wherein the bypass pipe is connected to lower part of the liquid pipe.

* * * * *